US009079197B2

(12) United States Patent
Bina et al.

(10) Patent No.: US 9,079,197 B2
(45) Date of Patent: Jul. 14, 2015

(54) DUAL POLYMER NEEDLES FOR DISPOSABLE FOAM DISPENSING GUN

(75) Inventors: Dave Bina, Northfield, OH (US); Laird Daubenspeck, Medina, OH (US); Stefan Gantenbein, Medina, OH (US); John McQuaid, Akron, OH (US)

(73) Assignee: Fomo Products, Inc., Norton, OH (US)

( * ) Notice: Subject to any disclaimer, the term of this patent is extended or adjusted under 35 U.S.C. 154(b) by 56 days.

(21) Appl. No.: 13/587,493

(22) Filed: Aug. 16, 2012

(65) Prior Publication Data

US 2014/0048560 A1 Feb. 20, 2014

(51) Int. Cl.

| | |
|---|---|
| ***B67D 7/78*** | (2010.01) |
| ***B05B 7/04*** | (2006.01) |
| ***B05B 7/12*** | (2006.01) |
| ***B01F 1/00*** | (2006.01) |

(52) U.S. Cl.

CPC ..... *B05B 7/0408* (2013.01); *B01F 1/00* (2013.01); *B05B 7/1209* (2013.01)

(58) Field of Classification Search

CPC .. B05B 12/002; B05B 7/0408; B05B 7/1209; B05B 7/2443

USPC ..... 222/145.1, 145.4–145.6, 136, 137; 239/414, 527

See application file for complete search history.

(56) References Cited

U.S. PATENT DOCUMENTS

| | | | | |
|---|---|---|---|---|
| 1,987,248 | A * | 1/1935 | Selzer | 239/414 |
| 5,462,204 | A | 10/1995 | Finn | |
| 6,158,624 | A * | 12/2000 | Grigg et al. | 222/145.6 |
| 6,345,776 | B1 * | 2/2002 | Hurray et al. | 239/413 |
| 6,527,203 | B2 * | 3/2003 | Hurray et al. | 239/413 |
| 6,698,622 | B2 * | 3/2004 | Sawhney et al. | 222/137 |
| 6,840,462 | B2 * | 1/2005 | Hurray et al. | 239/413 |
| 6,843,652 | B2 * | 1/2005 | Xie et al. | 433/90 |
| 6,991,185 | B2 * | 1/2006 | Brown | 239/414 |
| 7,044,402 | B2 * | 5/2006 | Finn | 239/302 |
| 7,559,440 | B2 * | 7/2009 | Rueschhoff et al. | 222/145.5 |
| 8,066,205 | B2 * | 11/2011 | Bass et al. | 239/526 |
| 8,365,958 | B2 * | 2/2013 | Ho et al. | 222/137 |
| 2008/0179554 | A1 * | 7/2008 | Finn | 251/122 |
| 2011/0209780 | A1 * | 9/2011 | Gantenbein et al. | 137/539 |

* cited by examiner

*Primary Examiner* — Kevin P Shaver
*Assistant Examiner* — Nicholas J Weiss
(74) *Attorney, Agent, or Firm* — Hahn Loeser & Parks LLP

(57) ABSTRACT

A metering component for a two-component dispensing gun includes a first metering rod and a second metering rod. The first metering rod includes a first tip section at one end that terminates into a first intermediate sealing section. The first intermediate sealing section terminates at a first base section at an opposite end of the first tip section. The second metering rod includes a second tip section at one end terminating in a second intermediate sealing section, wherein the second intermediate sealing section terminates at a second base section at an opposite end of the second tip section. The first metering rod is interconnected to the second metering rod at the first base section and the second base section.

18 Claims, 5 Drawing Sheets

DUAL POLYMER NEEDLES FOR DISPOSABLE FOAM DISPENSING GUN

TECHNICAL FIELD

The invention described herein relates generally to a two-component spray gun that utilizes a metering component to prevent uneven dispensing of components.

BACKGROUND OF THE INVENTION

This invention is particularly suited for in-situ applications of liquid chemicals mixed and dispensed as a spray or a foam and more specifically, to in-situ application of polyurethane foam or froth. In-situ applications for polyurethane foam have continued to increase in recent years extending the application of polyurethane foam beyond its traditional uses in the packaging, insulation and molding fields. For example, polyurethane foam is being used with increasing frequency as a sealant in the building trades for sealing spaces between windows and door frames and the like and as an adhesive for gluing flooring, roof tiles, and the like.

Polyurethane foam for in-situ applications is typically supplied as a "one-component" froth foam or a "two-component" froth foam in portable containers hand carried and dispensed by the operator through either a valve or a gun. However, the chemical reactions producing the polyurethane froth foam in a "one-component" polyurethane foam is significantly different from the chemical reactions producing a polyurethane froth foam in a "two-component" polyurethane foam. Because the reactions are different, the dispensing of the chemicals for a two-component polyurethane foam involves different and additional concepts and concerns than those present in the dispensing apparatus for a "one-component" polyurethane froth foam.

A "one-component" foam generally means that both the resin and the isocyanate used in the foam formulation are supplied in a single pressurized container and dispensed from the container through a valve or a gun attached to the container. When the chemicals leave the valve, a reaction with moisture in the air produces a polyurethane froth or foam. Thus, the design concerns related to an apparatus for dispensing one-component polyurethane foam essentially concerns the operating characteristics of how the one-component polyurethane foam is throttled or metered from the pressurized container. Post drip is a major concern in such applications as well as the dispensing gun not clogging because of reaction of the one component formulation with air (moisture) within the gun. To address or at least partially address such problems, a needle valve seat is typically applied as close to the dispensing point by a metering rod arrangement which can be pulled back for cleaning. While metering can occur at the needle valve seat, the seat is primarily for shut-off to prevent post drip, and depending on gun dimensioning, metering may principally occur at the gun opening.

In contrast, a "two-component" froth foam means that one principal foam component is supplied in one pressurized container, typically the "A" container (i.e., polymeric isocyanate, fluorocarbons, etc.) while the other principal foam component is supplied in a second pressurized container, typically the "B" container (i.e., polyols, catalysts, flame retardants, fluorocarbons, etc.). In a two-component polyurethane foam, the "A" and "B" components form the foam or froth when they are mixed in the gun. Of course, chemical reactions with moisture in the air will also occur with a two-component polyurethane foam after dispensing, but the principal reaction forming the polyurethane foam occurs when the "A" and "B" components are mixed or contact one another in the dispensing gun and/or dispensing gun nozzle. The dispensing apparatus for a two-component polyurethane foam application has to thus address not only the metering design concerns present in a one-component dispensing apparatus, but also the mixing requirements of a two-component polyurethane foam.

Further, a "frothing" characteristic of the foam is enhanced by the pressurized gas employed, e.g., fluorocarbon (or similar) component, which is present in the "A" and "B" components. This fluorocarbon component is a compressed gas which exits in its liquid state under pressure and changes to it gaseous state when the liquid is dispensed into a lower pressure ambient environment, such as when the liquid components exit the gun and enter the nozzle.

While polyurethane foam is well known, the formulation varies considerably depending on application. In particular, while the polyols and isocyanates are typically kept separate in the "B" and "A" containers, other chemicals in the formulation may be placed in either container with the result that the weight or viscosity of the liquids in each container varies as well as the ratios at which the "A" and "B" components are to be mixed. In dispensing gun applications which relate to this invention, the "A" and "B" formulations are such that the mixing ratios are generally kept equal so that the "A" and "B" containers are the same size. However, the weight, more importantly the viscosity, of the liquids in the containers invariably vary from one another. To adjust for viscosity variation between "A" and "B" chemical formulations, the "A" and "B" containers are charged (typically with an inert gas) at different pressures to achieve equal flow rates. The metering valves in a two-component gun, therefore, have to meter different liquids at different pressures at a precise ratio under varying flow rates. For this reason (among others), some dispensing guns have a design where each metering rod/valve is separately adjustable against a separate spring to compensate not only for ratio variations in different formulations but also viscosity variations between the components. The typical two-component dispensing gun in use today can be viewed as two separate one-component dispensing guns in a common housing discharging their components into a mixing chamber or nozzle. This practice, typically leads to operator errors. To counteract this adverse result, the ratio adjustment then has to be "hidden" within the gun, or the design has to be such that the ratio setting is "fixed" in the gun for specific formulations. The gun cost is increased in either event and "fixing" the ratio setting to a specific formulation prevents interchangeability of the dispensing gun.

Another element affecting the operation of a two-component gun is the design of the nozzle. The nozzle is typically a throw away item detachably mounted to the nose of the gun. Nozzle design is important for cross-over and metering considerations in that the nozzle directs the "A" and "B" components to a static mixer within the tip. For example, one gun completely divides the nozzle into two passages by a wall extending from the nozzle nose to the mixer. The wall lessens but does not eliminate the risk of cross-over since the higher pressurized component must travel into the mixer and back to the lower pressure metering valve.

A still further characteristic distinguishing two-component from one-component gun designs resides in the clogging tendencies of two-component guns. Because the foam foaming reaction commences when the "A" and "B" components contact one another, it is clear that, once the gun is used, the static mixer will clog with polyurethane foam or froth formed within the mixer. This is why the nozzles, which contain the static mixer, are designed as throw away items. In practice, the foam does not instantaneously form within the nozzle upon cessation of metering to the point where the nozzles have to be discarded. Some time must elapse. This is a function of the formulation itself, the design of the static mixer and, all things being equal, the design of the nozzle.

The dispensing gun of the present invention is particularly suited for use in two-component polyurethane foam "kits" typically sold to the building or construction trade. Typically, the kit contains two pressurized "A" and "B" cylinders (150-250 psi), a pair of hoses for connection to the cylinders and a dispensing gun, all of which are packaged in a container constructed to house and carry the components to the site where the foam is to be applied. When the chemicals in the "A" and "B" containers are depleted, the kit is sometimes discarded or the containers can be recycled. The dispensing gun may or may not be replaced. Since the dispensing gun is included in the kit, kit cost considerations dictate that the dispensing gun be relatively inexpensive. Typically, the dispensing gun is made from plastic with minimal usage of machined parts.

The dispensing guns cited and to which this invention relates are additionally characterized and distinguished from other types of multi-component dispensing guns in that they are "airless" and do not contain provisions for cleaning the gun. That is, a number of dispensing or metering guns or apparatus, particularly those used in high volume foam applications, are equipped or provided with a means or mechanism to introduce air or a solvent for cleaning or clearing the passages in the gun. The use of the term "airless" as used in this patent and the claims hereof means that the dispensing apparatus is not provided with an external, cleaning or purging mechanism.

Within each type of dispensing gun (e.g., one-component dispensing gun, two-component dispensing gun), a metering rod is utilized. Metering rod is a primary shutoff within the dispensing gun that meters or controls dispensing of material. Metering rod is often referred to as a needle or a pin and engages a female type receiver to meter or shutoff flow of chemical (e.g., material, component "A," component "B," etc.). In one-component dispensing guns, a single metering rod is included within a dispensing passage. In two-component dispensing guns, a metering rod is included within each dispensing passage associated with component (e.g., material). In an embodiment, two-component dispensing gun includes first dispensing passage and respective metering rod and second dispensing passage and respective metering rod. Upon use of a trigger, metering rod(s) allow material to be dispensed.

Fabrication of metering rods for dispensing guns include various challenges to produce an efficient dispensing gun at a reasonable price point. Typically, metering rods are fabricated incorporating brass, copper, and other materials (e.g., metallic, non-metallic, etc.). Yet, such materials have increased in cost and, in turn, increased cost of manufacturing dispensing guns. Furthermore, dispensing gun requires a secure mating between receiver and metering rod in order to prevent inconsistent metering (e.g., non-uniform dispensing of material, components, or chemical) and incomplete shut off (in a closed position). Inaccuracy between mating surfaces (e.g., receiver and metering rod) is typically overcome by forcing two elements together during initial assembly and allowing the more malleable of the two elements to take set. This technique is referred to as presetting and typically requires lengthy hold time which limits manufacturing of dispensing guns. Overall, presetting increases the possibility of enabling two mating surfaces to have secure connection (e.g., mating) to avoid leakage and/or non-uniform dispensing but adds to the manufacturing time.

Additionally, metallic metering rods are often fabricated with turning or grinding techniques. In particular, during creation of typical metallic metering rod(s), radial micro grooves are present due to such turning or grinding technique. With repeated use over duration of time, these micro grooves cause wear to the more malleable mating surface. In general, micro grooves grind or file away at the mating surface which can cause leakage of chemical/material at the mating surface.

While two-component dispensing guns discussed above function in a commercially acceptable manner, it is becoming increasingly clear as the number of in situ applications for polyurethane foam increase, that the range or the ability of the dispensing gun to function for all such applications has to be improved. As a general example, metering rods that meter amount of dispensed material need to be fabricated in a manner that prevent uneven dispensing of materials as well as prevent incomplete shutoff.

Further limitations and disadvantages of conventional, traditional, and proposed approaches will become apparent to one of skill in the art, through comparison of such systems and methods with certain embodiments the claimed invention as set forth in the remainder of the present application with reference to the drawings.

SUMMARY OF THE INVENTION

In one embodiment of the invention a metering component for a two-component dispensing gun includes a first metering rod and a second metering rod. The first metering rod includes a first tip section at one end that terminates into a first intermediate sealing section. The first intermediate sealing section terminates at a first base section at an opposite end of the first tip section. The second metering rod includes a second tip section at one end terminating in a second intermediate sealing section, wherein the second intermediate sealing section terminates at a second base section at an opposite end of the second tip section. The first metering rod is interconnected to the second metering rod at the first base section and the second base section.

In another embodiment of the invention a two-component dispensing gun includes the metering component, a trigger, a nozzle, a pair of hose openings, a pair of feed passages, a pair of dispensing passages, a metering component, and a pair of valve seats. The pair of feed passages are in communication at one end with the pair of hose openings and at an opposite end with the pair of dispensing passages at a position in a dispensing passage adjacent to a valve seat. The trigger can include a top portion and a bottom portion in which the top portion interfaces the metering component. The metering component includes a first metering rod and a second metering rod. The first metering rod includes a first tip section at one end terminating in a first intermediate sealing section and the first intermediate sealing section terminating at a first base section at an opposite end of the first tip section. The second metering rod a second tip section at one end terminating in a second intermediate sealing section and the second intermediate sealing section terminating at a second base section at an opposite end of the second tip section. The first metering rod is interconnected to the second metering rod at the first base section and the second base section. A portion of the metering component interfaces the pair of valve seats to meter a first component and a second component at a uniform rate from the two-component dispensing gun.

In yet another embodiment of the invention the metering component for a two-component dispensing gun includes a first metering rod and a second metering rod. The first metering rod includes a first tip section at one end that terminates into a first intermediate sealing section. The first intermediate sealing section terminates at a first base section at an opposite end of the first tip section. The second metering rod includes a second tip section at one end terminating in a second intermediate sealing section, wherein the second intermediate sealing section terminates at a second base section at an opposite end of the second tip section. The first metering rod is interconnected to the second metering rod at the first base section and the second base section. The first metering rod and the second metering rod are fabricated by an injection molding technique utilizing an acetal thermoplastic.

These and other advantages and novel features of the claimed invention, as well as details of illustrated embodiments thereof, will be more fully understood from the following description and drawings.

DETAILED DESCRIPTION OF THE INVENTION

The best mode for carrying out the invention will now be described for the purposes of illustrating the best mode known to the applicant at the time of the filing of this application. The examples are illustrative only and not meant to limit the invention, as measured by the scope and spirit of the claims.

Figure 1:
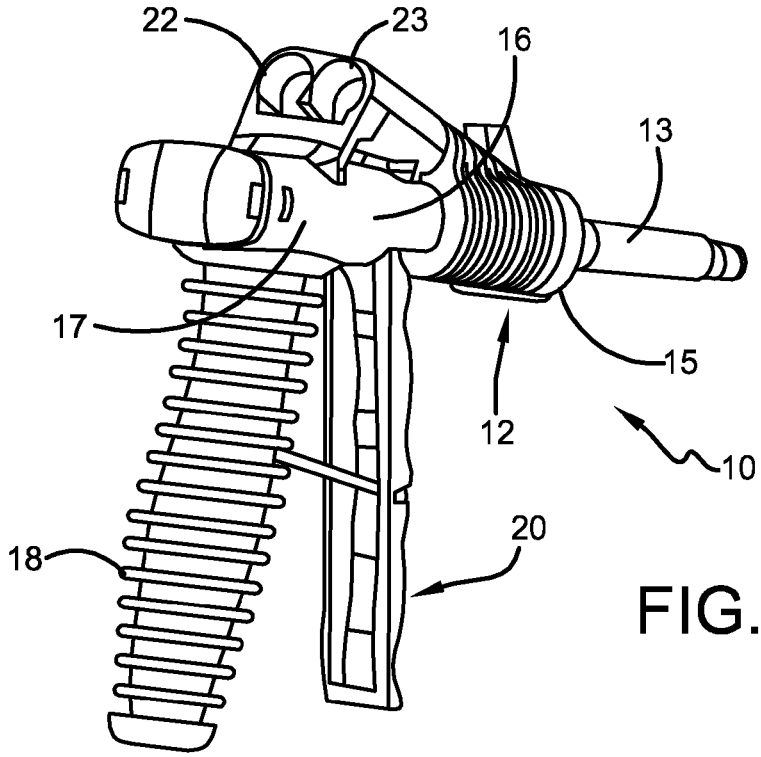
FIG. 1 illustrates a rear perspective view of a dispensing gun that may utilize an embodiment of the invention.
Figure 2:
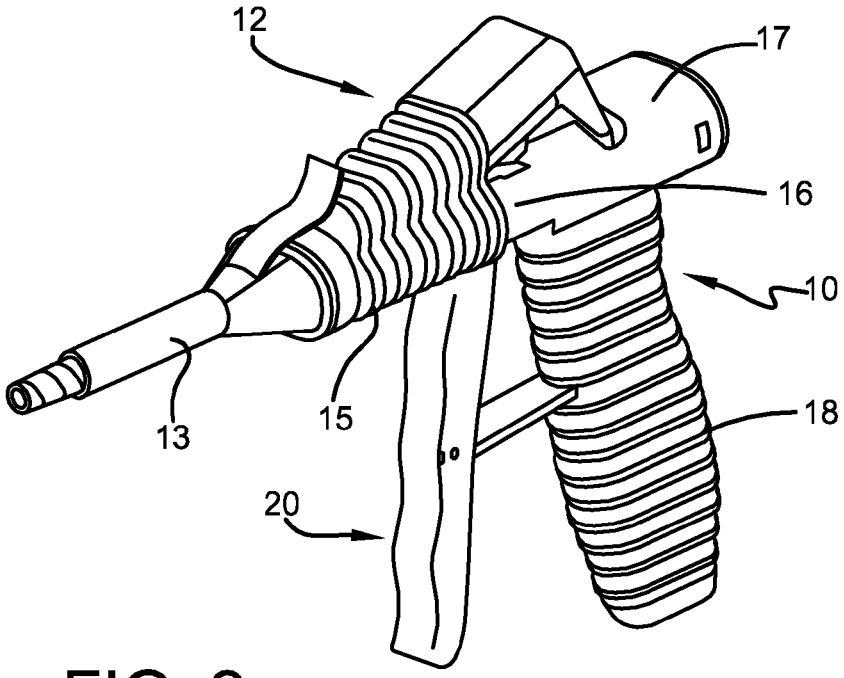
FIG. 2 illustrates a front perspective view of FIG. 1.

FIGS. 1 and 2 illustrate an airless two-component dispensing gun 10. Dispensing gun 10 may be viewed as comprising a one-piece gun body 12 (which includes components to be described) with a detachably secured disposable nozzle 13. In one preferred embodiment, the gun is molded from polypropylene and the nozzle is molded from an ABS (Acrylonitrile-Butadiene-Styrene) plastic. It is to be appreciated that any suitable plastic material can be utilized for the dispensing gun 10. While one of the objects of the invention is to provide an inexpensive dispensing gun achieved in part by the molding gun body 12 and nozzle 13 from plastic, the invention in its broader sense is not limited to a dispensing gun molded from any particular plastic and in a broader sense, includes metallic dispensing guns and/or dispensing guns with some metallic components.

Gun body 12 may be further defined as having integral portions including a longitudinally-extending valve portion 15 to which nozzle 13 is releasably connected and terminating at a longitudinally-extending trigger portion 16, in turn, terminating at longitudinally-extending spring portion 17 from which transversely extends handle portion 18. Within gun body housing 12 is a pair of hose openings 22, 23, canted as shown, to which the "A" and "B" hoses (not shown) are attached, respectively, by conventional quick connect couplings or other retaining mechanisms (e.g., friction fitting O-rings). Dispensing gun 10 is also provided with pivotable trigger 20 extending within trigger body portion 16. It should be appreciated that when the operator grasps dispensing gun 10 about handle 18 for finger actuation of trigger 20, that the position of hose openings 22, 23 is such that the kit hoses will drape over the operator's forearm which is preferred over other conventional hose attachment positions on the dispensing gun. For example, if the hose connections were attached to the handle bottom, it is possible for the hoses to become entangled with the operator's feet. If the hoses are attached to the rear end of the gun, the hoses rest on the operator's wrist. If the hoses are conventionally attached to the top of the gun, they can drape on either side of the gun and distort the pistol feel of the gun. Canting hose openings 22, 23 is thus believed to provide some ergonomic benefit while contributing to the improved performance of dispensing gun 10 as described below.

Figure 3:
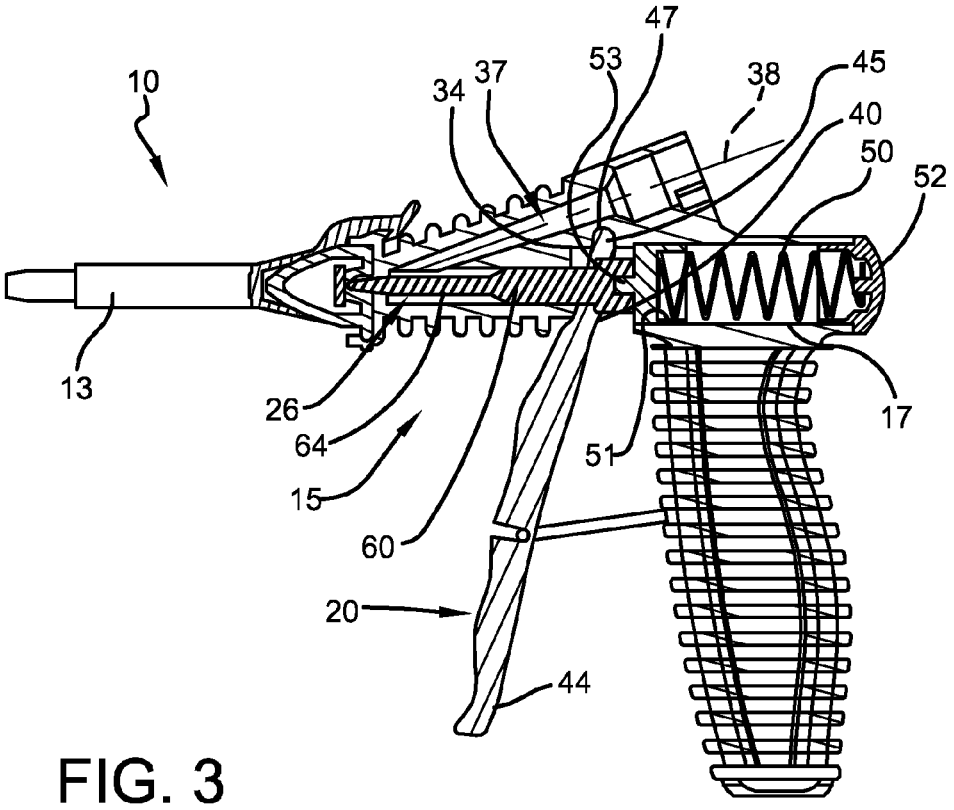
FIG. 3 illustrates a side elevational view of a cutaway of FIG. 1.
Figure 4:
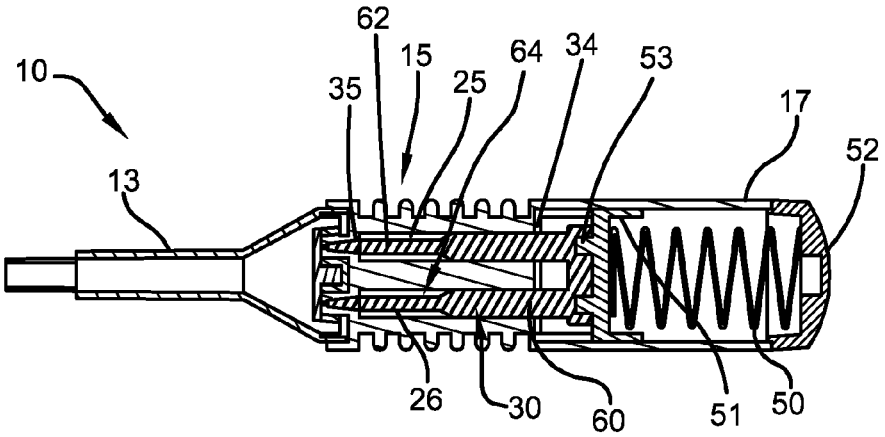
FIG. 4 illustrates a top elevational view of a cutaway of FIG. 1.

Referring now to FIGS. 3 and 4, dispensing gun 10 is shown in vertical and horizontal cross-section views, respectively, to best illustrate the overall relationship of the gun components. In gun body valve portion 15, there is formed a pair of parallel, open ended, laterally displaced and straight dispensing passages 25, 26 which are identical to one another so that a description of one dispensing passage such as a dispensing passage 25 for component "A" will apply to the other dispensing passage 26. Within each dispensing passage is placed a longitudinally-extending metering rod 64 and metering rod for dispensing the "A" component in passage 25 is not shown in FIG. 4 for drawing clarity. It is to be appreciated and understood that conventional dispensing guns include a metering rod for each chamber or dispensing passage 25, 26. However, dispensing gun 10 includes a metering component 60 that includes first metering rod 62 (also referred to as metering rod 62) and second metering rod 64 (also referred to as metering rod 64), wherein first metering rod 62 is interconnected to second metering rod 64 at a first base section of first metering rod 62 and a second base section of second metering rod 64. In other words, metering component 60 is a single module that includes first metering rod 62 and second metering rod 64. It is to be appreciated that reference to metering component 60 includes first metering rod 62 and second metering rod 64 as such rods are incorporated with one another at base sections. Dispensing gun 10 further includes metering rod 64 for dispensing passage 26 and metering rod 62 for dispensing passage 25. In comparison, a conventional two-component dispensing gun includes a separate metering rod for each dispensing chamber, wherein said metering rods are not interconnected.

For consistency in terminology, when describing dispensing gun 10, "longitudinal" will refer to the direction of the dispensing gun along the long axis of dispensing passage 25, 26 or metering rods 62, 64, i.e., x-x plane; "transverse" will refer to the direction of the gun along the long axis of handle portion 18, i.e., z-z plane; and, "laterally" will refer to the direction of the gun such as the distance spanning the spacing between dispensing passages 25, 26, i.e., the y-y plane.

Within valve body portion 15 are two laterally spaced and essentially straight feed passages 37 in fluid communication at one end with hose opening 22 or 23 and at the opposite end with dispensing passage 25 or 26 at a position in a dispensing passage adjacent valve seat 35. It is to be appreciated that there is a valve seat for each dispensing passage 25, 26 but valve seat 35 is illustrated for the sake of brevity. Feed passage 37 extends along axis 38 which forms an acute angle of about twenty degrees) (20°) with dispensing passage 25 or 26, preferably extending not greater than about thirty degrees (30°). The geometric arrangement of a longitudinally-extending dispensing passage through which a sealed metering rod extends with a feed passage in between the metering tip of the metering rod and the rod seal is somewhat similar to conventional arrangements used in one-component dispensing guns. However, the one-component guns introduce the one-component foam at a position spaced from the dispensing passage's valve seat and form angles with the feed passages larger than the acute angle of the present invention. Based on a review of existing two-component gun designs, it was concluded that improved metering of the dispensing gun is achieved if turbulent flow of the "A" and "B" components through the dispensing gun can be alleviated or minimized. Simply put, if abrupt changes in flow direction of the liquid foam components within the gun are avoided, improved gun operation will result. The arrangement of feed passages 37, dispensing passages 25, 26 and metering rods 62, 64 are believed to alleviate or reduce inconsistent metering and/or incomplete shutoff for the dispensing gun 10.

Referring still to FIGS. 3 and 4, trigger 20 has a top portion and a bottom portion. Top portion of trigger 20 interfaces with metering component 60. Extending transversely from top portion of trigger 20 in the direction of handle 18 is recessed trigger lever 44. Transversely extending from the opposite side of the top portion of trigger 20 is rounded trigger pivot portion 45. Trigger pivot portion 45 fits within U-shaped trigger recess 47 formed within trigger body portion 16. Trigger pivot portion 45 is not pinned or journaled within U-shaped recess 47 and can be viewed as floating. Movement of trigger lever 44 causes trigger pivot 45 to pivot within trigger recess 47 moving metering component 60 and each of first metering rod 62 and second metering rod 64 uniformly based at least in part upon metering rods 62, 64 being interconnected thereto. In other words, pulling trigger 20 causes both metering rods 62, 64 to release from receiver in a manner which causes metering of the "A" and "B" liquid components.

Within spring body portion 17 of dispensing gun 10, is positioned single spring 50. Spring 50 is compressed between inner spring retainer 51 and outer spring retainer 52 which perhaps, as best shown in FIG. 4, has a bayonet clip which snaps into openings in spring body portion 17. Inner spring retainer 51 has a pair of tubular projections 53 extending therefrom which allow connectivity to metering component 60. It is to be appreciated and understood that any suitable connections means can be employed to connect the metering component 60 to the tubular projections 53. The design of inner spring retainer 51 thus provides a form of alignment assuring equal travel of each metering rod 62, 64 in dispensing passages 25, 26 based upon metering component 60 being a single module. Moreover, the employment of a single spring further facilitates uniform dispensing from dispensing gun 10. In conventional, two-component dispensing guns in commercial use, separate springs are provided for each metering rod (perhaps to provide different spring forces for each metering rod) and each metering rod is separated from one another (e.g., not interconnected into a single module). As noted in the Background, the polyurethane foam or froth components under discussion are formulated to provide essentially equal ratios of the "A" and "B" components. When separate springs are used, it is possible for one spring to set when compared to the other spring, tending to result in an off-ratio dispensing gun. Two-component dispensing gun 10 of the present invention avoids this concern by using a single spring in combination with inner spring retainer 51 and metering component 60 of trigger 20 to assure that movement of trigger 20 will result in equal movement of both metering rods 62, 64 in dispensing passages 25, 26. Equal ratio metering is mechanically forced (e.g., via single module construction as well as single spring 50) and single spring 50 exerts a constant force on both metering rods 62, 64 which are interconnected into a single module (e.g., metering component 60). It is to be appreciated that the invention can utilize any suitable number of inner springs within spring body portion 17. For instance, in a preferred embodiment, a number of springs can equate the number of metering rods contained within single module metering component 60. In a more preferred embodiment, a single spring is implemented with single module metering component 60.

As mentioned above, first metering rod 62 and second metering rod 64 of metering component 60 are joined together as a single module. Such joining improves various factors associated with dispensing gun 10 in comparison to conventional dispensing guns. For instance, consistency of ratio is improved based at least in part upon first metering rod 62 and second metering rod 64 being joined for uniform metering of chemical. For instance, an amount of pressure on trigger 20 results in movement of metering component 60 which in turn allows both metering rods 62, 64 to move equally (in terms of an amount force and a distance which allows a flow of chemical). Moreover, gun face leakage is eliminated with metering component 60. Based on the fabrication of metering component 60 and material thereof, micro groove(s) are non-existent resulting in an elimination of gun face leakage due to micro grooves. A buildup of polyurea crystals is further eliminated due to the choice of plastic material of metering component 60 (discussed herein). Conventional techniques associated with metering rods often included buildup of polyurea crystals on the gun face due to deposits on the metering rod.

The interconnection of first metering rod 62 and second metering rod 64 ensure a uniform and improved metering. The dual polymer metering rods (e.g., single module metering component 60) provides a better on-ratio (e.g., one-to-one) metering of the two chemical streams due to the fact that the needles (e.g., metering rods 62, 64) are joined as one piece. Thus, metering component 60 retracts as a single unit. Conventional metering rods are typically metallic and seated on a back plate and pushed forward with one or more springs. Additionally, a longitudinal distance for the interconnected first metering rod 62 and second metering rod 64 is a same amount providing a uniform rate of dispensing for first component and second component from two-component dispensing gun 10.

Conventional techniques associated with metering components typically include needles (e.g., also referred to as metering rods) that allow a flow of chemicals through a hollow tube centrally located therein. For instance, a conventional needle contains a hollow cylindrical channel in which material flows through. Thus, conventional needles utilize hollow tubes which allow chemicals to flow through their center. Moreover, a flow of chemical is through the dispensing unit from a back of the dispensing unit and through the core or channel of the needles themselves. Chemical(s) can exit the hollow tubes or channels near the end of the needle into a chamber leading to a nozzle on a front end of the dispensing unit.

Metering component 60 allows a flow of chemical through the dispensing unit (e.g., two-component dispensing gun) such that chemical flows around metering rods 62, 64. With metering component 60, chemicals are delivered to a chamber in a front end of dispensing gun 10, wherein chemical flows around metering rods 62, 64 of the metering unit and utilized as a stopper or plug. The flow of chemical is around solid metering rod 62, 64 which allows greater chemical output than dispensing units that employ flow through hollow needles.

Metering component 60 is fabricated by an injection molding process. In a more preferred embodiment, metering component 60 is fabricated from a plastic utilizing an injection molding process. In a most preferred embodiment, metering component 60 is fabricated from acetal thermoplastic utilizing an injection molding technique. Acetal thermoplastic is a polymer that affords benefit to metering component 60 as further discussed below.

The fabrication of metering rods 62, 64 out of a polymer in conjunction with a polymer mating surface/receiver, assures intimate contact upon initial engagement. The two malleable surfaces, pin (e.g., the metering rod) and receiver, may deform slighting under the existing spring force to create a perfect seal upon first engagement. This initial seating of two components eliminates the need for "pre-setting" for any prolonged period, whereby removing limits to daily production of dispensing assemblies. In other words, by eliminating wait time for presetting, more dispensing assemblies and dispensing guns can be produced per unit time.

Furthermore, the use of polymer metering rods (e.g., entire metering component 60) allows the manufacture of metering component 60 through high volume and low cost injection molding techniques. Moreover, the injection molding technique enables metering component 60 to be fabricated to form the mating surface without micro grooves. In a preferred embodiment, the mating surface or "tip" of the needle (e.g., angled tip portion 78, 80 on metering rod 62, 64) is formed in the injection mold with a slide cavity. This allows the tip geometry (discussed in more detail below) to be produced without a parting line and in a direction of pull. In this preferred embodiment, an imperfection in the tip would occur in the same direction as the mating surface, thereby eliminating wear with continued use.

In a most preferred embodiment, metering component 60 is fabricated from acetal thermoplastic utilizing an injection molding technique. Acetal thermoplastics include material characteristics such as having a high chemical resistance and low friction characteristics (reducing wear on mating surfaces). Acetal thermoplastics further prevent buildup of polyurea and polyurethane crystals on the gun face which eventually prevent a good seal between metering rods 62, 64 and plastic gun face mating surface.

Figure 5:
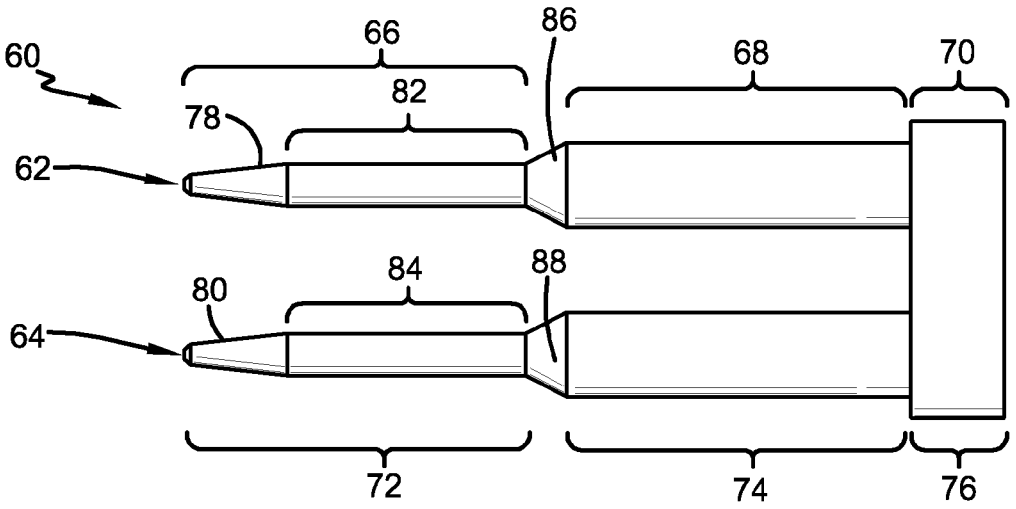
FIG. 5 illustrates a top perspective view of a metering component of an embodiment of the invention.
Figure 6:
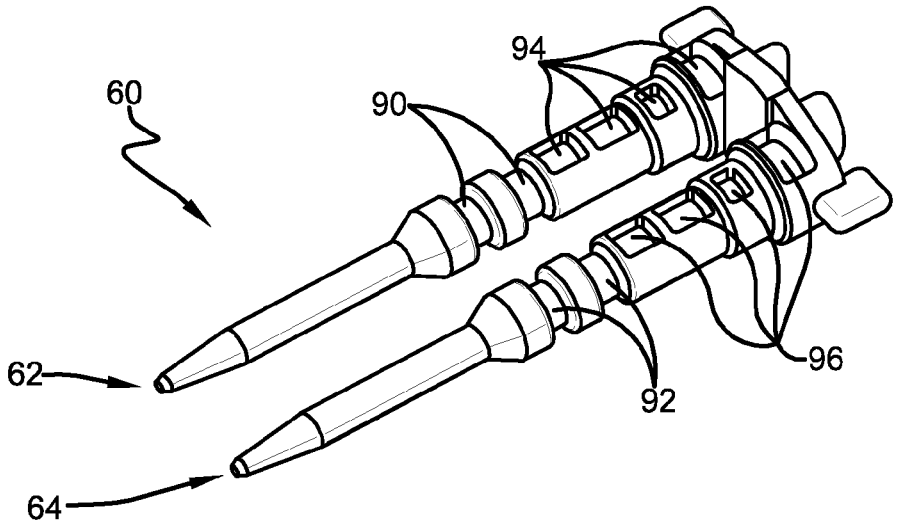
FIG. 6 illustrates a front perspective view of a metering component of an embodiment of the invention.
Figure 7:
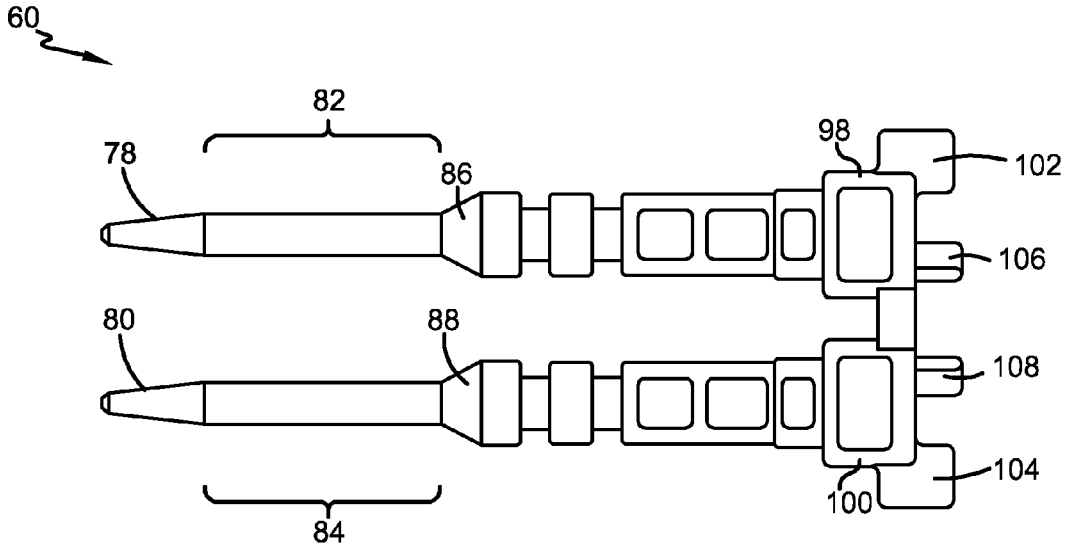
FIG. 7 illustrates a top perspective view of a metering component of an embodiment of the invention.
Figure 8:
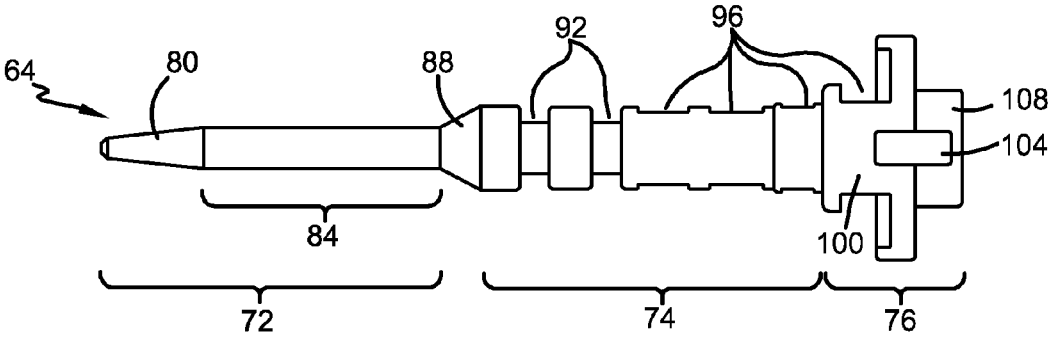
FIG. 8 illustrates a side view of a metering component of an embodiment of the invention.
Figure 9:
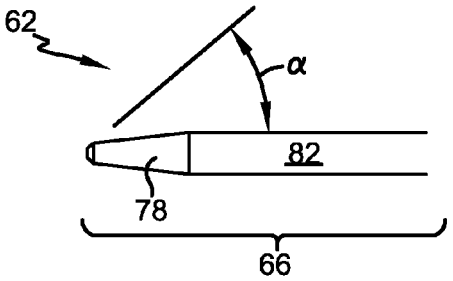
FIG. 9 illustrates an enlarged side view of another embodiment of the invention.
Figure 10:
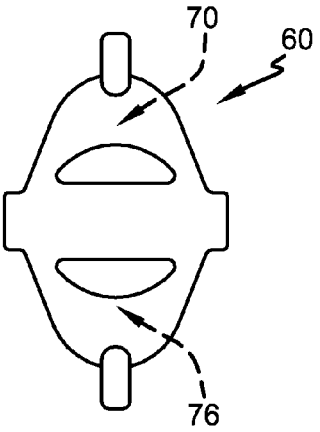
FIG. 10 illustrates a rear view of another embodiment of the invention.

Now turning to FIGS. 5-10, preferred embodiments of metering component 60 will be described in further detail. In general, FIG. 5 is a top perspective view of metering component 60, FIG. 6 is front perspective view of metering component 60, FIG. 7 is a top perspective view of metering component 60, FIG. 8 is a side view of metering component 60, FIG. 9 is an enlarged side view of another embodiment of metering component 60, while FIG. 10 illustrates a rear view of another embodiment of metering component 60.

In a preferred embodiment, metering component 60 is fabricated with an injection molding technique with material such as, but not limited to, plastics and/or polymers including various thermoplastics and thermosets, reinforced as well as unreinforced, more preferably a polyoxymethylene or acetal thermoplastic. Metering component 60 is fabricated as a single module or unit. Based at least upon the material of construction of metering component 60 coupled with its single module construction, numerous benefits over the conventional dispensing guns exist. As discussed above, the single module construction of metering component 60 optimizes uniform metering based upon the metering rod for each dispensing passage being interconnected restricting metering rod(s) to open/close at an identical rate. Polymer material (e.g., acetal thermoplastic, polyoxymethylene, etc.) for metering component 60 ensures the following: intimate contact between metering rod(s) and female receiver; fabrication without micro groves or parting-lines on metering rod tips (discussed in more detail below); reduction of build-up (e.g., acetal thermoplastic has a high chemical resistance and low friction characteristic, etc.); and fabrication with injection molding techniques without presetting (allowing a high volume, low cost production technique for manufacture).

It is to be appreciated that the below description of metering component 60 includes various preferred embodiments and is not to be limiting on the subject invention. For instance, metering component 60 is discussed in regard to two-component dispensing guns yet any suitable number of component(s) dispensing gun can be utilized with metering component 60.

Metering component 60 utilized with two-component dispensing gun 10 includes first metering rod 62 and second metering rod 64. In a preferred embodiment, metering component 60 including first metering rod 62 and second metering rod 64 are solid. In a more preferred embodiment, metering rods 62, 64 are at least one of solid cylindrical shapes or solid tubular shapes. It is to be appreciated that a cylindrical shape is one in which a radius is consistent for a height of such cylinder. It is to be appreciated that a tubular shape is one various radii exist for a height of such tubular shape. In a most preferred embodiment, metering rods 62, 64 are fabricated from acetal thermoplastic.

Metering rods 62, 64 will be defined in further detail below but generally have tip section (e.g., first tip section 66 for first metering rod 62, second tip section 72 for second metering rod 64), intermediate sealing section (e.g., first intermediate sealing section 68, second intermediate sealing section 74), and base section (e.g., first base section 70, second base section 76). Metering rod sections 66, 68, 72, and 74 are cylindrical in one preferred embodiment but conceptually could be tubular. Metering rods 62, 64 include respective sealing surfaces that close valve seat 35 for each dispensing passage 25, 26. The sealing surfaces closes pair of feed passages 37 to provide complete shutoff for dispensing gun 10. Sealing surfaces can be on an end of the metering rods 62, 64. In another embodiment, the sealing surfaces can be interposed between an end of the metering rods 62, 64 and an opposite end. In a more preferred embodiment, the sealing surfaces are first angled tip portion 78 and second angled tip portion 80.

First metering rod 62 includes first tip section 66, first intermediate sealing section 68, and first base section 70. First metering rod 62 includes first tip section 66 at one end terminating in first intermediate sealing section 68, in turn terminating at first base section 70 at an opposite end of first tip section 66. It is to be appreciated and understood that in a preferred embodiment of metering component 60, a surface area of a cross-section of first tip section 66 is less than a surface area of a cross-section of first immediate sealing section 68. Additionally, it is to be appreciated that first metering rod 62 is parallel to second metering rod 64.

Second metering rod 64 includes second tip section 72, second intermediate sealing section 74, and second base section 76. Second metering rod 62 includes second tip section 72 at one end terminating in second intermediate sealing section 74, in turn terminating at second base section 76 at an opposite end of second tip section 72. It is to be appreciated and understood that in a preferred embodiment of metering component 60, a surface area of a cross-section of second tip section 72 is less than a surface area of a cross-section of second immediate sealing section 74.

As discussed above, metering component 60 is a single module unit. In other words, metering component 60 is a single piece of material created by, for instance, an injection molding technique. First metering rod 62 is interconnected to second metering rod 64 at first base section 70 and second base section 76. In other words, first metering rod 62 and second metering rod 64 are physically connected together at the opposite end of tip sections 66, 72. The interconnection of first base section 70 and second base section 76 is further illustrated in a bottom view in FIG. 10.

Referring to FIG. 9 briefly, an enlarged view of metering rod tip section is illustrated. The metering rods are identical to one another so that the description and FIG. 9 of one metering rod tip section (e.g., first metering rod 62 and first tip section 66) will apply to the other metering rod tip section (e.g., second metering rod 64 and second tip section 72). First metering rod 62 includes first angled tip portion 78, while second metering rod 64 includes second angled tip portion 80. Moreover, first angled tip portion 78 terminates into first extension portion 82, while second angled tip portion 80 terminates into second extension portion 84. First angled tip portion 78 and second angled tip portion 80 include a respective pair of tangential planes. In a preferred embodiment, tangential planes form an angle ($\alpha$) in a range of about 3° to about 15°. In a more preferred embodiment, tangential planes form an angle ($\alpha$) a range of about 4° to about 10°. In a most preferred embodiment, tangential planes form an angle ($\alpha$) in a range of about 5° to about 7°.

First metering rod 62 includes first transition portion 86, wherein first transition portion 86 interposes first tip section 66 and first intermediate sealing section 68. Second metering rod 64 includes second transition portion 88, wherein second transition portion 88 interposes second tip section 72 and second intermediate sealing section 74. At least one of first transition portion 86 or second transition portion 88 includes a pair of tangential planes. In a preferred embodiment, first transition portion 86 and second transition period 88 include a curved surface. In a more preferred embodiment, the curved surface is a tangential portion of a circumference of a circle that has a corresponding radius. In a preferred embodiment, tangential planes of at least one of first transition portion 86 or second transition portion 88 form an angle in a range of about 10° to about 50°. In a more preferred embodiment, tangential planes of at least one of first transition portion 86 or second transition portion 88 form an angle in a range of about 20° to about 40°. In a most preferred embodiment, tangential planes of at least one of first transition portion 86 or second transition portion 88 form an angle of about 30°.

In a preferred embodiment, metering component 60 includes first metering rod 62 and second metering rod 64 having a cylindrical solid shape, wherein each metering rod 62, 64 includes respective first tip sections 66, 72, intermediate sealing sections 68, 74, and base sections 70, 76. (See FIGS. 3-5, 11, and 12). In a more preferred embodiment, metering rods 62, 64 respectively include at least one exterior sealing portion 90, 92 (discussed in more detail below). (See FIGS. 6-8). In a most preferred embodiment, metering rods 62, 64 include two exterior sealing portions 90, 92 and respective parallel cavities (discussed in more detail below). (See FIGS. 6-8).

Exterior sealing portions 90, 92 provide a leak-proof connection with a dispensing passage (e.g., dispensing passages 25, 26 of the two-component dispensing gun 10). Each metering rod 62, 64 has a pair of grooves as exterior sealing portions 90, 92 for an deformable sealant (not shown) such as, but not limited to, an O-ring seal. Deformable sealant prevents liquid component in dispensing passage 25 or 26 from escaping out. In a preferred embodiment, at least one exterior sealing portion are channels that encircle an outer peripheral surface of at least one of first intermediate sealing section 68 or second intermediate sealing section 74.

As discussed, the preferred material of construction of metering component 60 is a polymer. In a more preferred embodiment, the metering component 60 is fabricated from an acetal thermoplastic. In order to reduce the amount of material for the single module metering component 60, a number of parallel cavities 94, 96 reside on metering rods 62, 64. A set of parallel cavities includes a cavity on a top side of metering component 60 and a cavity on a bottom side of metering component 60. In a preferred embodiment, each metering rod 62, 64 includes at least one parallel cavity on a respective portion of intermediate sealing sections 68, 74. In a more preferred embodiment, each metering rod 62, 64 includes two or more parallel cavities on a respective portion of intermediate sealing sections 68, 74. In a most preferred embodiment, each metering rod 62, 64 includes three parallel cavities on a respective portion of intermediate sealing sections 68, 74. In a preferred embodiment, parallel cavities 94, 96 on intermediate sealing sections 68, 74 separate reinforcing ribs.

As is illustrated in FIG. 7, first base section 70 includes a first foundation 98, while second base section 76 includes a second foundation 100. First foundation 98 and second foundation 100 include respective surface area cross-sections that are greater than a surface area of a cross-section of at least one of intermediate sealing sections 68, 74 or tip sections 66, 72.

In a more preferred embodiment, metering component 60 includes first outer flange 102, second outer flange 104, first inner flange 106, and second outer flange 108 (collectively referred to as flanges 102, 104, 106, and 108). Flanges 102, 104, 106, and 108 provide interconnectivity between metering component 60 and trigger 20. In particular, trigger 20 includes a top portion and a bottom portion, wherein top portion interfaces metering component 60. In a preferred embodiment, top portion of trigger 20 interfaces metering component 60 via at least one flanges 102, 104, 106, 108. In a more preferred embodiment, metering component 60 includes at least one or more flange(s) to provide interfacing with trigger 20.

Figure 11:
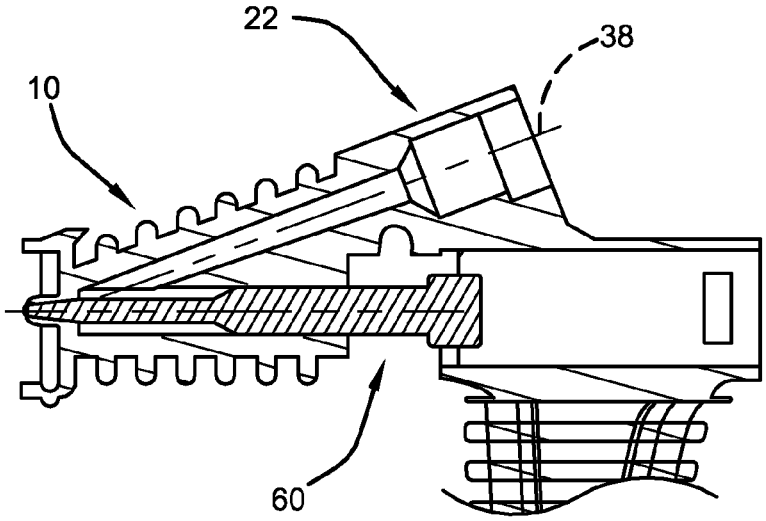
FIG. 11 illustrates a side elevational view in partial cross-sectional view of a dispensing gun utilizing the metering component.
Figure 12:
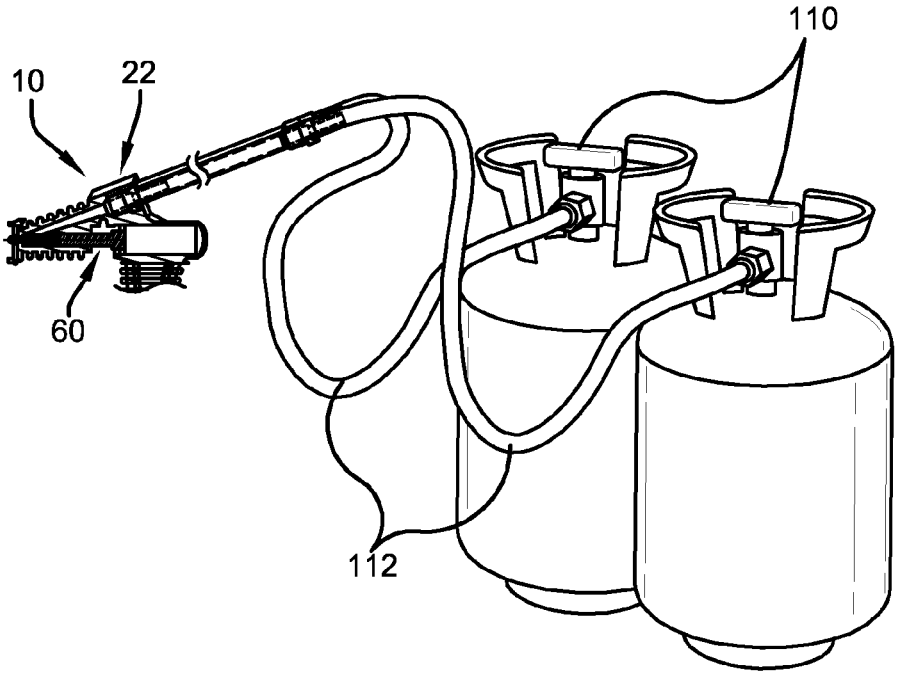
FIG. 12 illustrates a perspective view of a dispensing gun utilizing the metering component, a pair of hoses, and a pair of portable containers.

FIGS. 11 and 12 illustrate views of the two-component dispensing gun 10 utilizing the metering component 60. FIG. 11 illustrates a side elevational view of dispensing gun 10 utilizing metering component 60. Metering component 60 may be housed within the dispensing passages 25, 26, thereby metering material provided by the linking hose 112 to dispensing gun 10. FIG. 12 illustrates a perspective view of dispensing gun 10 utilizing metering component 60, pair of hoses 112, and pair of portable containers 110.

In the practice of this invention, illustrative and non-limiting examples of the polymers which may be used in various combinations to form the metering component 60 as well as polymers which may be used in injection molding would include: polyacetals, typically highly crystalline linear thermoplastic polymers of oxymethylene units; poly(meth)acrylics, typically belonging to two families of esters, acrylates and methacrylates; polyarylether ketones containing ether and ketone groups combined with phenyl rings in different sequences and polyether ketones; polyacrylonitrile resins wherein the principal monomer is acrylonitrile; nylons or polyamides, including various types of nylon-6, nylon-6/6, nylon-6/9, nylon-6/10, nylon-6/12, nylon-11, nylon-12; polyimide-imides formed by the condensation of trimellitic anhydride and various aromatic diamines; polyacrylates of aromatic polyesters derived from aromatic dicarboxylic acids and diphenols; polybutene resins based on poly(1-butene); polycarbonates, typically based on bisphenol A reacted with carbonyl chloride; polyalkylene terephthalates typically formed in a transesterification reaction between a dial and dimethyl terephthalate; polyetherimides, based on repeating aromatic imide and ether units; polyethylene homopolymers and copolymers, including all molecular weight and density ranges and degrees of crosslinking; polypropylene homopolymers and copolymers; ethylene acid copolymers from the copolymerization of ethylene with acrylic or methacrylic acid or their corresponding acrylate resins; ethylenevinyl acetate copolymers from the copolymerization of ethylene and vinyl acetate; ethylene-vinyl alcohol copolymers; polyimides derived from aromatic diamines and aromatic dianhydrides; polyphenylene oxides including polystyrene miscible blends; polyphenylene sulfides; acrylonitrile butadiene styrene terpolymers; polystyrenes; styrene-acrylonitrile copolymers; styrene-butadiene copolymers thermoplastic block copolymers; styrene maleic anhydride copolymers; polyarylsulfones; polyethersulfones; polysulfones; thermoplastic elastomers overing a hardness range of from 30 Shore A to 75 Shore D, including styrenic block copolymers, polyolefin blends (TPOS), elastomeric alloys, thermoplastic polyurethanes (TPUS), thermoplastic copolyesters, and thermoplastic polyamides; polyvinyl chlorides and chlorinated polyvinyl chlorides; polyvinylidene chlorides; allyl thermosets of allyl esters based on monobasic and dibasic acids; bismaleimides based generally on the condensation reaction of a diamine with maleic anhydride; epoxy resins containing the epoxy or oxirane group, including those epoxy resins based on bisphenol A and epichlorohydrin as well as those based on the epoxidation of multifunctional structures derived from phenols and formaldehyde or aromatic amines and aminophenols; phenolic resins; unsaturated thermoset polyesters including those of the condensation product of an unsaturated dibasic acid (typically maleic anhydride) and a glycol, wherein the degree of unsaturation is varied by including a saturated dibasic acid; thermoset polyimides; polyurethanes containing a plurality of carbamate linkages; and urea and melamine formaldehyde resins (typically formed by the controlled reaction of formaldehyde with various compounds that contain the amino group). It is to be appreciated that there are various Shore scales. The Shore A and Shore D scales are commonly used when referencing hardness of rubbers or synthetics. The Shore "A" scale ranges from 0 to 100 units, wherein the lower the Shore A value of a polymer, the softer the polymer, while the higher the value, the harder the polymer. The Shore "D" scale is generally used to measure harder plastics and polymers. In this invention the extruded profile polymer in the final product will have a higher Shore value than the injection molded polymer. The Shore values for the extruded profile polymer and the injection molded polymer used in the final tubing product may have any value from the Shore A or Shore D scale.

In a preferred embodiment, the polymer for metering component 60 is polyoxymethylene, also known as polyacetal and polyformaldehyde, sold commercially under the trade names of DELRIN, CELCON, HOSTAFORM, etc. Polyoxymethylene is a semi-cystalline homopolymer (75-85% crystalline) with a very low coefficient of friction. Polyoxymethylene homopolymer and copolymer have chain end groups (introduced via end capping) which consist in reducing depolymerization. With the copolymer, the second unit is a $C_2$ (e.g., ethylene glycol) or $C_4$ (e.g., 1,4-butanediol) unit.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A metering component for a two-component dispensing gun, comprising:

a first metering rod, and a second metering rod parallel to the first metering rod;

said first and second metering rods comprising a polymer having a high chemical resistance and low friction, said first and second metering rods having no micro grooves;

wherein the first metering rod comprises a first metering rod sealing surface on one end and a first metering rod base section on an opposite end;

wherein the second metering rod comprises a second metering rod sealing surface on one end and a second metering rod base section on an opposite end; and wherein the first metering rod, first metering rod base section, second metering rod and second metering rod base section are molded as a one-piece metering component, by forming a laterally-extending cross-member of said first metering rod base section and said second metering rod base section; and further wherein said laterally-extending cross-member has at least a pair of flanges on an opposed side of the laterally-extending cross-member of the first and second metering rods, said laterally-extending cross-member in mating engagement with a spring retainer for keeping said first and second rod sealing surfaces biased in a closed position in combination with a spring in biased communication with said laterally-extending cross-member; and still further wherein said first and second metering rods in combination with said first and second metering rod base sections form an interconnected unitary module which moves within two laterally spaced apart dispensing passages within a housing of said two-component dispensing gun by pivotal movement of a trigger in connectivity with said flanges of said laterally-extending cross-member, each of said passages within said housing terminating with a valve seat at a fixed position within said housing for said dispensing passages.

2. The metering component of claim 1, wherein the first metering rod comprises a first tip section at one end terminating in a first intermediate sealing section, the first intermediate sealing section terminating at the first metering rod base section at an opposite end of the first tip section; and wherein the second metering rod comprises a second tip section at one end terminating in a second intermediate sealing section, the second intermediate sealing section terminating at the second metering rod base section at an opposite end of the second tip section.

3. The metering component of claim 1, wherein at least one of the first metering rod and the second metering rod is made of a thermoplastic, selected from the group consisting of a homopolymer and a copolymer of polyoxymethylene.

4. The metering component of claim 1, wherein at least one of the first metering rod and the second metering rod is a solid cylindrical shape.

5. The metering component of claim 1, wherein at least one of the first metering rod and the second metering rod is a solid tubular shape.

6. The metering component of claim 2, wherein a surface area of a cross-section of the first tip section is less than a surface area of a cross-section of the first intermediate sealing section; and wherein a surface area of a cross-section of the second tip section is less than a surface area of a cross-section of the second intermediate sealing section.

7. The metering component of claim 2, wherein the first tip section comprises a first angled tip portion and the second tip section comprises a second angled tip portion.

8. The metering component of claim 7, wherein at least one of the first angled tip portion and the second angled tip portion comprises a pair of tangential planes.

9. The metering component of claim 8, wherein the tangential planes form an angle of 5° to 7°.

10. The metering component of claim 7, wherein the first angled tip portion terminates into a first extension portion and the second angled tip portion terminates into a second extension portion.

11. The metering component of claim 2, wherein the first metering rod comprises a first transition portion that interposes the first tip section and the first intermediate sealing section; and wherein the second metering rod comprises a second transition portion that interposes the second tip section and the second intermediate sealing section.

12. The metering component of claim 11, wherein at least one of the first transition portion and the second transition portion comprises a pair of tangential planes.

13. The metering component of claim 12, wherein the pair of tangential planes forms an angle of 20° to 40°.

14. The metering component of claim 2, wherein at least one of the first intermediate sealing section and the second intermediate sealing section comprises at least one exterior sealing portion providing a leak-proof connection with a dispensing passage of the two-component dispensing gun.

15. The metering component of claim 14, wherein in the at least one exterior sealing portion are channels that encircle an outer peripheral surface of at least one of the first intermediate sealing section and the second intermediate sealing section.

16. The metering component of claim 2, wherein at least one of the first intermediate sealing section and the second intermediate sealing section comprises a pair of parallel cavities.

17. A two-component dispensing gun, comprising:

a trigger, a nozzle, a pair of hose openings, a pair of feed passages within a housing, a pair of parallel dispensing passages, a metering component movable by pivotal movement of the trigger, and a pair of valve seats in a fixed location within the housing;

wherein the pair of feed passages are in communication at one end with the pair of hose openings and at an opposite end with the pair of parallel dispensing passages at a position in the parallel dispensing passages adjacent to the valve seats;

wherein the trigger comprises a top portion and a bottom portion;

wherein the top portion interfaces the metering component;

wherein the metering component comprises a first metering rod and a second metering rod;

said first and second metering rods comprising a polymer having a high chemical resistance and low friction, said first and second metering rods having no micro grooves;

wherein the first metering rod comprises a first metering rod sealing surface on one end and a first metering rod base section on an opposite end;

wherein the second metering rod comprises a second metering rod sealing surface on one end and a second metering rod base section on an opposite end;

wherein the first metering rod is interconnected to the second metering rod at respective first metering rod base section and second metering rod base section forming a laterally-extending cross-member; and wherein said first metering rod, first metering rod base section, second metering rod, and second metering rod base section form a one-piece metering component;

wherein said cross-member has at least a pair of protrusions on an opposed side from the first and second metering rods, said at least a pair of protrusions in mating engagement with a spring retainer in parallel with said laterally-extending cross-member for keeping said first and second rod sealing surfaces biased in a closed position in combination with a spring in biased communication with said spring retainer, said at least a pair of protrusions in connectivity with said trigger;

wherein the sealing surfaces of the metering component interface with the pair of valve seats to close flow of a first component and a second component through the pair of dispensing passages; and wherein a longitudinal movement for the interconnected first metering rod and second metering rod is an equal amount providing a uniform rate of dispensing for the first component and the second component; and wherein said one-piece metering component is constructed of a polymer which prevents the buildup of polyurea and polyurethane crystals.

18. A metering component for longitudinal movement within a housing of a two-component dispensing gun, comprising:

a first metering rod, and a second metering rod;

wherein the first metering rod comprises a first metering rod sealing surface on one end and a first metering rod base section on an opposite end;

wherein the second metering rod comprises a second metering rod sealing surface on one end and a second metering rod base section on an opposite end;

wherein the first metering rod is parallel to the second metering rod;

wherein the first metering rod is interconnected to the second metering rod at respective first metering rod base section and second metering rod base section forming a laterally-extending cross-member; and wherein said first metering rod, first metering rod base section, second metering rod, second metering rod base section form a one-piece metering component;

wherein said cross-member has at least a pair of protrusions on an opposed side from the first and second metering rods, said at least a pair of protrusions in mating engagement with a spring retainer in parallel with said laterally-extending cross-member for keeping said first and second rod sealing surfaces biased in a closed position in combination with a spring in biased communication with said spring retainer, said at least a pair of protrusions in connectivity with a trigger for longitudinal movement of said metering component within said housing; and the first metering rod and the second metering rod are an acetal thermoplastic which prevent the buildup of polyurea and polyurethane crystals.

* * * * *